US009034435B2

(12) United States Patent
Ishizuka et al.

(10) Patent No.: US 9,034,435 B2
(45) Date of Patent: May 19, 2015

(54) COATED PRINTING PAPERS AND PROCESSES FOR PREPARING THEM

(75) Inventors: Kazuhiko Ishizuka, Tokyo (JP); Osamu Kozuka, Tokyo (JP); Ryo Sotooka, Tokyo (JP); Susumu Kato, Tokyo (JP)

(73) Assignee: NIPPON PAPER INDUSTRIES CO., LTD., Tokyo (JP)

( * ) Notice: Subject to any disclaimer, the term of this patent is extended or adjusted under 35 U.S.C. 154(b) by 110 days.

(21) Appl. No.: 14/008,086

(22) PCT Filed: Mar. 22, 2012

(86) PCT No.: PCT/JP2012/057287

§ 371 (c)(1), (2), (4) Date: Sep. 27, 2013

(87) PCT Pub. No.: WO2012/133088

PCT Pub. Date: Oct. 4, 2012

(65) Prior Publication Data

US 2014/0023844 A1 Jan. 23, 2014

(30) Foreign Application Priority Data

Mar. 29, 2011 (JP) ..... 2011-071778

(51) Int. Cl.

| | |
|---|---|
| ***D21H 23/48*** | (2006.01) |
| ***D21H 21/28*** | (2006.01) |
| ***D21H 19/66*** | (2006.01) |
| ***D21H 19/72*** | (2006.01) |
| ***D21H 19/38*** | (2006.01) |
| *D21H 11/08* | (2006.01) |
| *D21H 11/14* | (2006.01) |

(52) U.S. Cl.

CPC ..... *D21H 19/66* (2013.01); *D21H 23/48* (2013.01); *D21H 11/08* (2013.01); *D21H 11/14* (2013.01); *D21H 19/385* (2013.01); *D21H 19/72* (2013.01); *D21H 21/28* (2013.01)

(58) Field of Classification Search

CPC ..... D21H 23/48; D21H 21/28; D21H 19/66; D21H 19/72; D21H 19/385

USPC ..... 427/427

See application file for complete search history.

(56) References Cited

U.S. PATENT DOCUMENTS

| | | | |
|---|---|---|---|
| 2002/0170691 | A1 | 11/2002 | Nygard et al. |
| 2003/0188839 | A1 | 10/2003 | Urscheler |
| 2006/0251819 | A1 | 11/2006 | Zama et al. |

FOREIGN PATENT DOCUMENTS

| | | |
|---|---|---|
| JP | 04-185798 | 7/1992 |
| JP | 05-106198 | 4/1993 |
| JP | 11-107193 | 4/1999 |
| JP | 11-302998 | 11/1999 |
| JP | 2000-345493 | 12/2000 |
| JP | 2004-204409 | 7/2004 |
| JP | 2004-225219 | 8/2004 |
| JP | 2004-527669 | 9/2004 |
| JP | 2008-230898 | 10/2008 |
| JP | 2009-529076 | 8/2009 |
| JP | 2010-53481 | 3/2010 |
| WO | 2007/101203 | 9/2007 |
| WO | 2007/101822 | 9/2007 |
| WO | 2011/115167 | 9/2011 |

OTHER PUBLICATIONS

International Preliminary Report on Patentability for PCT/JP2012/057287, and English translation thereof.

International Search Report for PCT/JP2012/057287 dated May 29, 2012.

Extended European Search Report, dated Oct. 16, 2014, issued in related EP Application No. 12765253.5.

*Primary Examiner* — Bruce H Hess

(74) *Attorney, Agent, or Firm* — Roylance Abrams, Berdo & Goodman, L.L.P.

(57) ABSTRACT

The present invention aims to provide techniques for preparing matte coated printing papers having high opacity and brightness as well as improved brightness variation at low basis weight with good runnability.

According to the present invention, a process for preparing a matte coated printing paper having a basis weight of 60 to 90 g/m$^2$, a brightness of 75% or more, and an opacity of 95% or more is provided, comprising applying a coating solution containing calcium carbonate by curtain coating on a base paper having a brightness of 45 to 70% made from a raw material pulp containing a total of 50% or more of deinked pulp and/or mechanical pulp.

5 Claims, No Drawings

COATED PRINTING PAPERS AND PROCESSES FOR PREPARING THEM

TECHNICAL FIELD

The present invention relates to coated printing papers and processes for preparing them. Specifically, the present invention relates to techniques for efficiently preparing matte coated printing papers having high levels of both opacity and brightness as well as less brightness variation at low basis weight.

BACKGROUND ART

Recently, there is a growing trend toward reducing the basis weight of coated printing papers to meet demands for lighter prints for the purposes of saving resources, transportation costs and the like. As the basis weight decreases, the opacity generally decreases, but if the opacity is low, images printed on one side appear on the other side, thereby reducing the value of the prints. Thus, it would be desirable to maintain high opacity at low basis weight.

In addition to these demands, there has recently been a high demand for communicating the contents of prints in a visually impressive manner by frequently using photographs and graphics and further colorizing them. In such a demand, brightness is important. This is because if brightness is low, printed images appear darker than intended so that their contents are communicated less impressively. However, brightness and opacity are normally contradictory to each other, and there is a tendency that when brightness is high, opacity is low, while when opacity is high, brightness is low. Thus, it is necessary to strike a balance between brightness and opacity.

As to brightness, not only brightness determined by conventional methods but also "brightness variation" is important. As used herein, brightness variation is defined as the standard deviation of brightness in microscopic areas. Prints having significant brightness variation lose their value even if they have high brightness because they are poor in surface appearance and the variation is further emphasized especially in halftone dot areas of the prints. Generally, brightness variation is especially prominent when there is a great difference in brightness between the base paper and the coating layer. Thus, attempts were made to reduce brightness variation by using a base paper having somewhat high brightness to reduce the difference in brightness between the base paper and the coating layer or the like, but the high-brightness base paper resulted in low opacity.

As indicated above, it is difficult to prepare prints having high levels of both opacity and brightness as well as improved brightness variation at low basis weight with good runnability by conventionally known methods.

SUMMARY OF INVENTION

Technical Problem

The present invention aims to provide techniques for preparing matte coated printing papers having high opacity and brightness as well as improved brightness variation at low basis weight with good runnability.

Solution to Problem

As a result of careful studies to solve the problems described above, we achieved the present invention on the basis of the finding that matte coated printing papers having high opacity and brightness as well as improved brightness variation at low basis weight can be obtained with good runnability by applying a coating solution by curtain coating on a low-brightness base paper.

Accordingly, the present invention includes, but not limited to, the following aspects:

(1) A process for preparing a matte coated printing paper having a basis weight of 60 to 90 g/m$^2$, a brightness of 75% or more, and an opacity of 95% or more, comprising applying a coating solution containing calcium carbonate by curtain coating on a base paper having a brightness of 45 to 70% made from a raw material pulp containing a total of 50% or more of waste paper pulp and/or mechanical pulp.

(2) The process as defined in (1) wherein the coating mass per side is 12 to 30 g/m$^2$.

(3) The process as defined in (1) or (2) wherein the calcium carbonate used is precipitated calcium carbonate in the form of spindle-like particles having an average particle size (D50) of 0.3 to 0.8 μm and a particle size distribution curve determined by the sedimentation method in which the ratio of the particle size of 75 cumulative % by mass of particles (D75) to the particle size of 25 cumulative % by mass of particles (D25) (D75/D25) is 1.5 or more and less than 3.5.

(4) The process as defined in any one of (1) to (3) wherein the coating speed of the curtain coating is 800 m/min or more.

(5) The process as defined in any one of (1) to (4) wherein the coating solution contains a rheology modifier consisting of a W/O emulsion of an aqueous solution of a polycarboxylic acid copolymer having a weight average molecular weight of 4,000,000 to 50,000,000 dispersed in an organic solvent.

(6) A matte coated printing paper prepared by the process as defined in any one of (1) to (5).

Advantageous Effects of Invention

According to the present invention, matte coated printing papers having high levels of both opacity and brightness, which were conventionally difficult to achieve simultaneously, as well as less brightness variation at low basis weight can be obtained with good runnability from low-brightness base papers.

DESCRIPTION OF EMBODIMENTS

The coated printing papers of the present invention are obtained by applying a pigment coating solution containing calcium carbonate as a white pigment by curtain coating on a low-brightness base paper containing much waste paper pulp and/or mechanical pulp. According to the present invention, brightness and opacity can be improved simultaneously, and matte coated printing papers having less brightness variation at low basis weight can be efficiently prepared.

Base Paper

In the present invention, a base paper having a brightness of 45 to 70% made from a raw material pulp containing a total of 50% or more of waste paper pulp and/or mechanical pulp is used. The pulp used may have a brightness of 45% to 70%, for example, because the base paper typically reflects the brightness of the pulp used.

The base paper used in the present invention employs a total of 50% or more of waste paper pulp and/or mechanical pulp as a raw material pulp. The use of the base paper having such a pulp composition allows the opacity of the resulting coated printing paper to be greatly improved. The reason for this is not exactly known, but may be explained as follows: the opacity of the coated printing paper may increase because waste paper pulp enhances light absorption due to low brightness and/or mechanical pulp enhances light scattering due to the low density of the resulting paper. The waste paper pulp may or may not be deinked, and deinked pulp that can be used may be derived from sorted waste papers such as woodfree paper, wood-containing paper, mechanical paper, news, advertising leaflets and magazines or unsorted waste papers including mixtures of them.

Generally, base papers made from mechanical pulp or waste paper pulp are known to be not only poor in brightness but also liable to brightness variation due to uneven water absorption because the coating solution has excessively high water absorbency so that the coating solution readily penetrates into paper layers and fails in coverage. However, the present invention surprisingly succeeded in reducing brightness variation while using large amounts of mechanical pulp or the like by adopting the curtain coating method described below. Especially, base papers using much mechanical pulp or the like conventionally have low smoothness, but brightness variation is reduced according to the present invention even if a low-smoothness base paper incorporating much mechanical pulp or waste paper pulp is used.

The reason why coated printing papers with less brightness variation can be obtained while using large amounts of mechanical pulp or the like in the present invention is not known in detail, but may be explained as follows. In the most common blade coating method, a coating solution is forced into a base paper with a blade so that if the base paper has low smoothness and any variation in water absorbency, the variation of the base paper cannot be compensated for by the coating layer and may be readily reflected as brightness variation. In the curtain coating method used in the present invention, however, it is presumed that a coating layer preliminarily formed as a curtain film is deposited on a base paper so that the curtain film and the base paper come into gentler and softer contact with each other than in blade coating and the variation of the base paper can be compensated for by the soft coating layer. It is also presumed that the coating solution is not forced into the base paper during coating in the curtain coating method so that more pigments contained in the coating solution remain on the surface of the base paper to improve coverage of the base paper and the coating layer becomes porous and bulky to enhance light scattering.

In the present invention, a low-brightness base paper is used. The base paper has a brightness as low as 45 to 70%, preferably 55 to 70%. If the brightness is lower than 45%, brightness variation is improved but sufficient brightness is not achieved after coating, whereas if the brightness is higher than 70%, light absorption is poor so that sufficient opacity is not achieved after coating. When the base paper has a brightness in the above ranges, desired levels of both brightness and opacity can be achieved.

Preferably, the base paper used in the present invention has a basis weight in a range of 30 to 66 g/m$^2$, more preferably in a range of 33 to 50 g/m$^2$, still more preferably in a range of 35 to 45 g/m$^2$ to provide a low-basis weight coated printing paper. If the basis weight is lower than 30 g/m$^2$, paper strength decreases and web breaks are likely to occur during operation, whereby the production efficiency decreases. If the basis weight is higher than 66 g/m$^2$, the coating mass must be decreased to provide a low-basis weight coated paper, which makes it difficult to achieve high levels of brightness, opacity and brightness variation simultaneously.

Preferably, the base paper used in the present invention has a density of 0.40 to 0.70 g/cm$^3$, more preferably 0.40 to 0.60 g/cm$^3$, still more preferably 0.45 to 0.55 g/cm$^3$. Base papers having a density of higher than 0.7 g/cm$^3$ are not preferred because the porosity is too low to provide sufficient light scattering in the base paper layer and therefore, sufficient opacity. On the other hand, base papers having a density of lower than 0.4 g/cm$^3$ are not preferred because paper strength decreases so that web breaks frequently occur during operation and the production efficiency decreases. In the curtain coating method used in the present invention, the density of the base paper can be selected in a relatively low range because brightness variation can be effectively reduced as compared with other coating methods even if the base paper has low density and low smoothness.

Further, the base paper of the present invention can be precalendered. The smoothness of the base paper may be improved by precalendering the base paper as appropriate because if the smoothness of the base paper is very low, the smoothness of the resulting coated paper will also be low though the uneven water absorbency and low smoothness of the base paper can be compensated for by curtain coating as described above. As a means for improving the smoothness of the base paper, the base paper can be precoated with a starch-based clear coating or a pigmented coating before curtain coating. This precoated base paper may be subjected to curtain coating without passing through a drying step, i.e., while the coating on the base paper is still wet. Thus, the state of the precoated base paper before being subjected to curtain coating is not limited.

The base paper of the present invention can contain known fillers and known additives such as paper strength enhancers. Fillers contained in the base paper preferably include calcium carbonate.

Curtain Coating

In the present invention, a coating solution containing a white pigment is applied on the base paper described above by curtain coating. As used herein, curtain coating refers to a coating method according to which a coating solution is allowed to fall in the form of a curtain to form a curtain film and a base paper is passed through the curtain film to deposit a coating layer on the base paper. Curtain coating is contour coating by which a coating layer is formed to contour the base paper and characterized in that the coating mass can be readily controlled because it is a so-called premetered method.

In addition to the most common blade coating method, known coating methods for pigment-coated papers include film transfer coating, air knife coating and the like. In the present invention, high quality requirements are satisfied by adopting curtain coating among a number of coating methods.

In the blade coating method, a coating solution is forced into a base paper with a blade so that if the base paper has low smoothness and any variation in water absorbency, the variation of the base paper cannot be compensated for by the coating layer and may be readily reflected as brightness variation, as described above.

Film transfer coating is a coating method according to which a film of a coating solution is metered on an applicator and transferred onto a base paper to deposit a coating layer. As compared with blade coating, a smaller load is applied on the base paper during coating so that the coating solution is less likely to penetrate into the base paper and improves in coverage, but as compared with curtain coating, some load is inevitably applied during coating because the base paper is nipped between applicator rolls, resulting in poor coverage, low brightness and brightness variation. Film transfer coating also has the disadvantage that an operational problem called boiling occurs during high-speed operation.

Air knife coating is a coating method according to which an excessive coating solution is deposited on a base paper, and then a pressurized air stream called air knife is delivered onto the coating surface to blow off the excess. As compared with blade coating, a smaller load is applied on the base paper, but as compared with curtain coating, some load is inevitably applied during coating. Further, the air knife coater can use only low-viscosity coating solutions because it blows off the excess of coating with an air stream. This is because if viscosity is high, the velocity of the air stream must be increased, but if the velocity of the air stream is high, turbulent vortices occur to cause coating streaks on the coating surface. This problem becomes more prominent during high-speed operation because the velocity of the air stream must be high. If the solids content of the coating solution is decreased to reduce the viscosity of the coating solution, not only the load to be dried increases but also the coating solution tends to excessively penetrate into the base paper during drying, which makes it difficult to obtain coated papers with less brightness variation especially when a base paper as defined herein is used.

The coated papers of the present invention are prepared by applying a single layer or multiple layers by curtain coating on both sides or one side of a base paper. In multi-layer coating, some layers may be applied by using a coater other than a curtain coater, e.g., a pigment coating solution may be applied with a curtain coater and then with a blade coater, or blade coating may be followed by curtain coating. Further, wet-on-wet coating may take place by applying an upper layer without drying a lower coating layer. However, at least the coating layer adjacent to the base paper is preferably applied by curtain coating to maximize the benefit from curtain coating because the base paper used in the present invention has uneven water absorbency and low smoothness as described above.

In the present invention, known equipment used for curtain coating can also be used. For example, a pump for feeding the coating solution, a deaerator for deaerating the coating solution and the like can be used.

In the present invention, the curtain coating speed is not specifically limited, but the coating speed is preferably 600 m/min or more, more preferably 800 m/min or more, still more preferably 1000 m/min or more. In curtain coating, the curtain film is pulled by the base paper running at high speed and so-called craters are more likely to be generated as the coating speed increases, but the generation of craters can be conveniently reduced even during high-speed operation at about 2000 m/min by adding a rheology modifier to attain a specific time to rupture.

Preferably, the coated printing papers of the present invention have a coating mass per side in a range of 12 to 30 g/m$^2$, more preferably 15 to 20 g/m$^2$. Coating masses less than 12 g/m$^2$ are not preferred because sufficient brightness and opacity cannot be attained. On the other hand, coating masses more than 20 g/m$^2$ are not preferred because binder migration occurs during drying, resulting in uneven ink adhesion or picking during printing. In the present invention, the coating mass is preferably in a range of relatively high values to maximize the high coverage by curtain coating.

Pigment Coating Solution

In the present invention, a pigment coating solution containing at least calcium carbonate is applied by curtain coating on a base paper. The pigment coating solution of the present invention can be prepared by mixing water, a pigment and other additives. The pigment coating solution may be prepared by mixing water, a pigment and other additive at the same time, but preferably by preparing a slurry of water and a pigment in advance and adding other additives to this slurry because of workability. Conventional mixing means such as a mixer may be used for mixing. The coating solution used in the present invention may further contain other ingredients such as surfactant. These ingredients are explained below.

The coating solution used in the present invention contain calcium carbonate, preferably calcium carbonate in the form of spindle-like particles as a white pigment. In the present invention, other pigments are not specifically limited so far as calcium carbonate is used and conventional pigments for coated papers can be used. For example, inorganic pigments such as kaolin, clay, titanium dioxide, barium sulfate, calcium sulfate, zinc oxide, silicic acid, silicates, colloidal silica, and satin white; organic pigments such as plastic pigment; or organic/inorganic composite pigments or the like can be used, and these pigments can be used alone or a mixture of two or more of them may be used as appropriate. In the present invention, calcium carbonate may be a sole white pigment. When a combination of two or more white pigments is used, the combination is preferably calcium carbonate with kaolin and/or clay.

As described above, the coating solution of the present invention contains calcium carbonate such as ground calcium carbonate or precipitated calcium carbonate, but preferably contains precipitated calcium carbonate in the form of spindle-like particles having an average particle size (D50) of 0.3 to 0.8 μm and a particle size distribution curve determined by the sedimentation method in which the ratio of the particle size of 75 cumulative % by mass of particles (D75) to the particle size of 25 cumulative % by mass of particles (D25) (D75/D25) is 1.5 or more and less than 3.5 to improve runnability during high-speed operation and the quality of the resulting coated paper. Such calcium carbonate has the effect of improving the coverage of the base paper because of the narrow particle size distribution. It also has a high aspect ratio because it is in the form of spindle-like particles. When calcium carbonate is used as a white pigment in the present invention, ground calcium carbonate and precipitated calcium carbonate in the form of spindle-like particles as described above are preferably used in combination.

As compared with contact-type coating methods, the non-contact-type curtain coating method tends to have more difficulty in orienting pigments in the traveling direction of the base paper so that the resulting coated paper is likely to be poor in the smoothness of the surface when high-aspect ratio pigments are used. However, it is thought that when curtain coating takes place at high speed, pigments tend to be regularly oriented because the curtain film is pulled by the base paper running at high speed, with the result that more evener high-smoothness coating layers can be readily obtained when the calcium carbonate in the form of spindle-like particles is used during high-speed operation. However, the present invention is not bound to this hypothesis.

In the present invention, the dynamic surface tension of the coating solution can be controlled by using a surfactant. Among surfactants including anionic surfactants, cationic surfactants and nonionic surfactants, anionic surfactants are preferred in the present invention. Cationic surfactants promote aggregation of pigments in the coating solution. On the other hand, nonionic surfactants are less likely to confer sufficient wettability on the coating solution. Examples of anionic surfactants include sulfonate surfactants, sulfate ester surfactants and carboxylate surfactants. Among them, sulfonate surfactants are preferred, and especially preferred are alkyl sulfosuccinates because the wettability by the coating solution can be more improved.

The amount of the anionic surfactants to be added is preferably 0.1 to 1% by weight based on the total solids content of pigments in the coating solution. If the amount is less than 0.1% by weight, the wettability of the base paper by the coating solution may be insufficient. If the amount is greater than 1% by weight, however, the wettability of the base paper by the coating solution may be excessive so that the coating solution may excessively penetrate into the base paper to degrade the quality of the resulting coated paper. These surfactants can be used alone or as a combination of two or more of them.

In the present invention, the curtain coating solution may contain a rheology modifier for controlling the viscosity. The rheology modifier is preferably a rheology modifier consisting of a W/O emulsion of an aqueous solution of a polycarboxylic acid copolymer having a weight average molecular weight of 4,000,000 to 50,000,000 dispersed in an organic solvent. This rheology modifier is hereinafter also referred to as "W/O emulsion rheology modifier". The rheology modifier refers to a chemical used for altering the viscosity of a system.

The polycarboxylic acid copolymer refers to a polymer obtained by polymerizing a carboxyl-containing monomer or a derivative thereof. Examples of carboxyl-containing monomers include acrylic acid, maleic acid, and methacrylic acid. Examples of derivatives of carboxyl-containing monomers include mono- or dialkaline earth metal salts, mono- or diesters, amides, imides, and anhydrides of these monomers. When maleic acid, methacrylic acid or a derivative thereof is used as the monomer, the resulting coating solution may have insufficient spinnability because a branched chain is introduced into the molecular structure of the polymer. When acrylic acid or a derivative thereof is used as the monomer, however, the resulting coating solution improves in spinnability more efficiently because the polymer has a straight-chain molecular structure. Thus, acrylic acid or an acrylic acid derivative is preferably used as the monomer in the present invention. Further, the polycarboxylic acid copolymer is used in the state of a W/O emulsion in the present invention. Thus, the monomer preferably comprises a sodium salt of acrylic acid and acrylamide because a W/O emulsion can be readily generated. These monomers may be in any ratio, but preferably 50:50 to 5:95 in a molar ratio.

The rheology modifier used in the present invention is a W/O emulsion of an aqueous solution of the polycarboxylic acid copolymer dispersed in an organic solvent. Such a W/O emulsion rheology modifier can be prepared by, for example, 1) adding a surfactant to an organic solvent at room temperature and homogeneously mixing them, 2) adding a monomer dissolved in water to this mixture to prepare a preemulsion, and 3) adding a polymerization initiator to this preemulsion and stirring the mixture at a high temperature to polymerize the monomer. Organic solvents that can be used include known organic solvents such as toluene, xylene, kerosene, isoparaffin and the like. Surfactants that can be used also include known surfactants such as sorbitan monostearate. The W/O emulsion rheology modifier preferably has a solids content of 20 to 60% by weight.

The polycarboxylic acid copolymer has a weight average molecular weight of 4,000,000 to 50,000,000. If the weight average molecular weight is less than 4,000,000, sufficient spinnability cannot be conferred on the coating solution. If the weight average molecular weight is higher than 50,000,000, the effect of thickening the coating solution is too strong to feed the coating solution. To strike a balance between spinnability and pumpability or the like, the weight average molecular weight is more preferably 10,000,000 to 30,000,000. The weight average molecular weight can be determined as a polystyrene equivalent molecular weight by analyzing the polymer by gel permeation chromatography.

Polycarboxylic acid copolymers are conventionally used as thickeners or water retention agents in the field of coated printing papers, but such copolymers conventionally used have a weight average molecular weight in a range of several tens of thousands to several hundreds of thousands. In the present invention, the spinnability of the coating solution can be improved and craters in curtain coating can be reduced by using a polycarboxylic acid copolymer having a very high weight average molecular weight that is not conventionally used, as described above.

The W/O emulsion rheology modifier is advantageous in handling because its own viscosity is not too high. Generally, rheology modifiers are used to increase the viscosity of coating solutions, but the W/O emulsion rheology modifier increases the viscosity of coating solutions moderately rather than excessively and also confers spinnability. Thus, the W/O emulsion rheology modifier can improve spinnability of the coating solutions without impairing handling properties of the coating solutions. This may be attributed to, but not limited to, the following reason.

In the W/O emulsion rheology modifier, a copolymer is confined in an aqueous dispersed phase so that molecular chains are not extended and little molecular chains are entangled with each other. Thus, the rheology modifier is advantageous in handling because its own viscosity is not too high even if it contains a copolymer having a very high molecular weight as described above. When the W/O emulsion rheology modifier is mixed with water into a coating solution, however, a thickening effect is produced because the aqueous dispersed phase is converted into a continuous phase and molecular chains of the copolymer are extended and entangled with each other.

In contrast, O/W emulsion rheology modifiers themselves have high viscosity because a copolymer exists in the dispersed phase and molecular chains are entangled with each other. Especially when the copolymer has a weight average molecular weight of 1,000,000 or more, such rheology modifiers are very difficult to handle because they have considerably high viscosity. Further, it is difficult to homogeneously thicken coating solutions with such rheology modifiers because they are difficult to homogeneously mix into the coating solutions. Thus, handling properties of the coating solutions such as pumpability are greatly impaired, and sufficient spinnability cannot be conferred on the coating solutions.

To reduce the generation of craters, the amount of the rheology modifier to be added is preferably 0.05 parts by weight or more per 100 parts by weight of total pigments in a coating solution. If the amount is less than 0.05 parts by weight, sufficient spinnability may not be conferred on the coating solution. If the amount is higher than 0.5 parts by weight, the generation of craters can be reduced but the viscosity of the coating solution becomes too high so that the solids content of the coating solution must be greatly decreased, whereby the coating solution may excessively penetrate into the base paper to degrade the quality of the resulting coated paper. To strike a balance between the spinnability of the coating solution and the quality of the coated paper, the amount is more preferably 0.1 to 0.3 parts by weight.

In the present invention, the curtain coating solution preferably contains an adhesive (binder). The adhesive is not specifically limited, and adhesives conventionally used in coated papers can be used. Examples of adhesives include typical adhesives for coated papers including synthetic adhesives such as various copolymers including styrene-butadiene copolymers, styrene-acrylic copolymers, ethylene-vinyl acetate copolymers, butadiene-methyl methacrylate copolymers and vinyl acetate-butyl acrylate copolymers, or polyvinyl alcohols, maleic anhydride copolymers and acrylic-methyl methacrylate copolymers; proteins such as casein, soybean protein and synthetic proteins; starches such as oxidized starches, cationized starches, starch carbamate/phosphate esters, etherified starches including starch hydroxyethyl ethers, and dextrin; and cellulose derivatives such as carboxymethyl cellulose, hydroxyethyl cellulose and hydroxymethyl cellulose. One or more of the adhesives can be appropriately selected and used. In a preferred embodiment, these adhesives are used in a range of about 5 to 50 parts by weight, more preferably 8 to 30 parts by weight per 100 parts by weight of pigments. Synthetic adhesives are preferred because they do not significantly increase the viscosity of the coating solution, among which polyvinyl alcohols having a low degree of polymerization are preferably used because they can enhance adhesive effects without significantly increasing viscosity. The degree of polymerization is preferably 1000 or less, more preferably 700 or less, and the degree of polymerization may be about 500.

In the present invention, various additives contained in conventional pigments for coated papers can be used as appropriate such as dispersants, thickeners, water retention agents, defoamers, waterproofing agents, colorants, etc.

Preferably, the coating solution used in the present invention has a time to rupture of 200 ms or more. The time to rupture of a coating solution is a measure of spreadability (spinnability) of the coating solution. Coating solutions having a longer time to rupture mean coating solutions having higher spinnability. If the time to rupture is shorter than 200 ms, the coating solution is less likely to follow the instantaneous elongation of the curtain film caused by the difference between the falling speed of the curtain film and the traveling speed of the base paper when the curtain film comes into contact with the base paper. This may cause film breakage and cratering. The upper limit of the time to rupture is not specifically limited, but preferably does not exceed 500 ms, because the flowability of the coating solution decreases to impair the pumpability of the coating. In this case, it is possible to decrease the solids content of the coating solution, but not preferable because the quality of the resulting coated paper is degraded by excessive penetration of the coating solution into the base paper.

The time to rupture in the present invention is measured using an extensional rheometer. Specifically, the time to rupture is determined using a rheometer comprising a pair of coaxial circular plates having a diameter of 8 mm mounted on the same vertical axis by: 1) placing a coating solution at a temperature of 30° C. between the plates (in a gap of 1 mm), 2) vertically lifting up the upper plate by 8 mm at a speed of 400 mm/sec and keeping it at that position, and 3) measuring the time from the start of lifting the plate to rupture of the filament of the coating solution. The time before the filament breaks is preferably measured by a laser preferably at a time resolution of about 2 ms. Examples of rheometers capable of such measurement include an extensional rheometer available from Thermo Scientific (type HAAKE CaBER1).

Preferably, the coating solution used in the present invention has a Brookfield viscosity of 500 to 3000 mPa·s, more preferably 800 to 3000 mPa·s at 30° C. The Brookfield viscosity of the coating solution is measured by using a No. 4 rotor at a rotation speed of 60 rpm. As used herein, numerical ranges include their endpoints.

Coating solutions having a Brookfield viscosity lower than 500 mPa·s are not preferred even if the time to rupture is 200 ms or more because the coating solutions excessively penetrate into the base paper to degrade the quality of the resulting coated paper. On the other hand, coating solutions having a Brookfield viscosity higher than 3000 mPa·s are not preferred because their flowability decreases to impair the pumpability of the coating solutions.

Characteristics of the coating solution used in the present invention such as time to rupture and viscosity can be controlled primarily by the amount of the rheology modifier added. These characteristics can also be somewhat controlled by increasing the solids content of the coating solution. This is because the increased solids content facilitates interaction between pigment particles and other ingredients in the coating solution to elongate the time to rupture of the coating solution. When the solids content of the coating solution is high, the print quality of the resulting coated paper also improves.

According to the present invention, the curtain coating solution can be provided with moderate viscosity rather than excessive by using a specific rheology modifier as described above. Thus, the solids content of the coating solution can be increased, and the print quality of the resulting coated paper can also be improved. Preferably, the solids content of the coating solution is 58% by weight or more, more preferably 62% by weight or more. If the solids content is lower than 58% by weight, the quality of the resulting coated paper may be degraded by excessive penetration of the coating solution into the base paper. On the other hand, the upper limit of the solids content is not specifically limited, but preferably 75% by weight or less, more preferably 70% by weight or less to improve pumpability and the like.

Preferably, the coating solution used in the present invention has a dynamic surface tension in the flow state or simply a dynamic surface tension of 25 to 45 mN/m. The dynamic surface tension refers to the surface tension on a freshly formed liquid surface before it reaches equilibrium with the bulk and provides a measure of wettability by a coating solution in the flow state. Wettability provides a measure of spreadability of a coating solution on the surface of a substrate. High wettability generally means that the coating solution readily spreads on the surface of a substrate. In other words, coating solutions having a dynamic surface tension in the above range are likely to reduce the generation of craters because they show good wettability immediately after they come into contact with paper.

In the present invention, the dynamic surface tension is determined by the maximum bubble pressure method. The maximum bubble pressure method refers to a method according to which bubbles (interfaces) are continuously generated from a probe having a radius r inserted into a liquid and the surface tension is determined from the pressure applied on bubbles when the radius of the bubbles equals the radius r of the probe (maximum bubble pressure) by the equation below.

$$\text{Surface tension } \gamma = \Delta P \times r/2$$

wherein ΔP represents the difference between the maximum bubble pressure and the minimum bubble pressure (atmospheric pressure).

Specifically, the dynamic surface tension is determined by changing times from the instant when a fresh interface is generated in the tip of the probe to the instant when the maximum bubble pressure is reached (life times) and measuring the dynamic surface tension in each life time. Wettability by a liquid in the flow or stirred state can be evaluated by measuring the dynamic surface tension in a short time in this manner. In other words, the dynamic surface tension in a very initial state closer to the flow state can be determined as the life time is shorter. In the present invention, the dynamic surface tension is preferably defined as the surface tension value in a life time of 100 ms in view of measurement precision. This dynamic surface tension can be measured by using an automatic dynamic surface tensiometer ("BP-D5" from Kyowa Interface Science Co., Ltd.) or the like.

The dynamic surface tension of the coating solution used in the present invention can be controlled by adding a surfactant. Preferably, the dynamic surface tension of the coating solution used in the present invention is 45 mN/m or less to reduce cratering. If the dynamic surface tension is higher than 45 mN/m, the wettability of the base paper by the coating solution is insufficient so that cratering may not be sufficiently reduced. If the dynamic surface tension is lower than 25 mN/m, however, cratering can be reduced, but the coating solution may excessively penetrate into the base paper due to the excessive wettability of the base paper by the coating solution to degrade the quality of the resulting coated paper. Consequently, the coating solution used in the present invention preferably has a dynamic surface tension of 25 to 45 mN/m, more preferably 25 to 35 mN/m.

Calendering

The coated papers of the present invention are prepared through conventional drying steps after a coating layer is applied on a base paper. Generally, coating layers are commonly calendered and calendering may take place in the present invention, but any surface treating step by calendering is preferably omitted. In the curtain coating method used in the present invention, no load is applied on the base paper and the coating layer during coating so that the bulkiness of the base paper and the coating layer is retained, but the bulkiness is canceled out if calendering takes place. Further, the loss of porosity of the coating layer by calendering is undesirable because light scattering of the coating layer decreases, the low-brightness base paper layer becomes conspicuous and brightness also decreases. Thus, the present invention is suitable for matte coated papers not subjected to calendering after coating.

Coated Printing Paper

In the present invention, high-quality prints with less print unevenness can be obtained by curtain coating without calendering. The coated printing papers of the present invention can be applied to various printing methods, among which they are especially suitable for offset printing.

The coated printing papers of the present invention have a relatively low basis weight (light weight), specifically a basis weight in a range of 60 to 90 g/m$^2$, more preferably 70 to 90 g/m$^2$. Coated printing papers having a basis weight in these ranges have small thickness and therefore should have high opacity, which can be readily attained by the present invention.

The coated printing papers of the present invention have an opacity of 95% or more. Values lower than 95% are not preferred because images printed on one side appear on the other side, thereby reducing the value of the prints.

The coated printing papers of the present invention have a brightness of 75% or more. Values lower than 75% cannot be sufficient for typical coated printing paper and are not preferred because printed images appear darker than intended so that their contents are communicated less impressively. In the curtain coating method used in the present invention, the difference between the brightness of the base paper and the brightness of the coated printing paper is not specifically limited because brightness variation is improved even if there is a great difference in brightness between the base paper and the coating layer.

Preferably, the coated printing papers of the present invention have a density in a range of 0.8 to 1.1 g/cm$^3$.

Preferably, the coated printing papers of the present invention have a glossiness of 40% or less.

EXAMPLES

The following examples further illustrate the present invention without, however, limiting the invention thereto. As used herein, parts and % refer to parts by weight and % by weight, respectively, and numerical ranges are indicated to include their endpoints, unless otherwise specified.

[Evaluation Methods]

(1) Basis weight: determined according to JIS P8124 "Paper and board—Determination of grammage".

(2) Density: determined according to JIS P8118 "Paper and board—Determination of thickness and density".

(3) Opacity: determined according to JIS P8149 "Paper and board—Determination of opacity (paper backing)—Diffuse reflectance method", using a colorimeter (CMS-35SPX from Murakami Color Research Laboratory Co., Ltd.) with a light source including a UV component.

(4) Brightness: determined according to JIS P8148 "Paper, board and pulps—Measurement of diffuse blue reflectance factor (ISO brightness)", using a colorimeter (CMS-35SPX from Murakami Color Research Laboratory Co., Ltd.).

(5) Brightness variation: visually evaluated according to the 3-class scale below: ○: no variation can be identified, Δ: some identifiable variation, x: visible variation.

(6) Time to rupture: determined using an extensional rheometer (type HAAKE CaBER1 from Thermo Scientific) by: 1) placing a coating solution at a temperature of 30° C. between a pair of coaxial circular plates having a diameter of 8 mm mounted on the same vertical axis of the rheometer (in a gap of 1 mm), 2) vertically lifting up the upper plate by 8 mm at a speed of 400 mm/sec and keeping it at that position, and 3) measuring the time from the start of lifting the plate to rupture of the filament of the coating solution.

(7) Dynamic surface tension: The surface tension was determined by measuring the maximum pressure (maximum bubble pressure) by the maximum bubble pressure method using an automatic dynamic surface tensiometer (BP-D5 from Kyowa Interface Science Co., Ltd.) when bubbles were continuously generated from a probe (small-diameter tube) inserted into a coating solution. Specifically, the dynamic surface tension was defined as the surface tension value in a life time (the time from the instant when a fresh interface is generated in the tip of the probe to the instant when the maximum bubble pressure is reached) of 100 ms.

Example 1

[Preparation of a Base Paper]

Raw material pulps were mixed in proportions of 5% of bleached kraft pulp (brightness 80%), 20% of mechanical pulp (brightness 60%), and 75% of waste paper pulp (brightness 51%) and defibered to give a pulp slurry having a Canadian standard freeness (CSF) adjusted to 200 cc. To this pulp slurry were added 0.1% of polyacrylamide and 0.15% of a retention improver based on the absolute dry weight of the pulps as well as 8.0% of fresh precipitated calcium carbonate (having a rosette particle shape and an average particle size of 3.0 μm) as a filler based on the weight of the base paper to prepare a stock.

The resulting stock was converted into a neutral paper having a basis weight of 40.0 g/m$^2$ in a gap former paper machine. The base paper had a density of 0.62 g/cm$^3$, an opacity of 95%, and a brightness of 55%.

[Preparation of a Pigment Coating Solution]

To a pigment system consisting of 50 parts of ground calcium carbonate (FMT-97 from FIMATEC Ltd.) and 50 parts of precipitated calcium carbonate in the form of spindle-like particles (Tama Pearl TP-221-70GS from OKUTAMA KOGYO CO., LTD.; D75/D25=2.5) were added 10 parts of a styrene butadiene latex (NP-200B from JSR) and 0.5 parts of PVA (Poval 105 from Kuraray Co., Ltd.; degree of polymerization 500) as adhesives, followed by 1 part of a fluorescent dye (Blankophor Z-NSP from Kemira), 0.2 parts of a surfactant (Newcol 291PG from NIPPON NYUKAZAI CO., LTD.), and 0.1 part of a W/O emulsion rheology modifier (SOMAREX 530 from SOMAR Corporation) based on the total pigments, and water was further added to give a coating solution having a solids content of 65%. This pigment coating solution had a Brookfield viscosity of 1000 mPa·s at 30° C., 60 rpm.

[Preparation of a Printing Paper]

The coating solution described above was applied on both sides at a coating mass of 20 g/m$^2$ per side at a coating speed of 1000 m/min using a curtain coater, and dried to give a coated printing paper. No calendering took place.

Example 2

A coated printing paper was obtained in the same manner as in Example 1 except that the proportions of pulps in the base paper were changed to 25% of bleached kraft pulp, 20% of mechanical pulp, and 55% of waste paper pulp. The base paper had a density of 0.48 g/cm$^3$, an opacity of 86%, and a brightness of 70%.

Example 3

A coated printing paper was obtained in the same manner as in Example 1 except that the basis weight of the base paper was changed from 40 g/m$^2$ to 30 g/m$^2$. The base paper had a density of 0.62 g/cm$^3$, an opacity of 88%, and a brightness of 55%.

Comparative Example 1

A coated printing paper was obtained in the same manner as in Example 1 except that the proportions of pulps in the base paper were changed to 55% of kraft pulp, 20% of mechanical pulp, and 25% of waste paper pulp. The base paper had a density of 0.68 g/cm$^3$, an opacity of 80%, and a brightness of 75%.

Comparative Example 2

A coated printing paper was obtained in the same manner as in Example 1 except that the coating method was changed from curtain coating to blade coating and that the surfactant and the rheology modifier were not added to the coating solution. The coating solution had a Brookfield viscosity of 500 mPa·s.

Comparative Example 3

A coated printing paper was obtained in the same manner as in Example 1 except that the coating method was changed from curtain coating to rod metering size press (RMSP) coating and that the surfactant and the rheology modifier were not added to the coating solution. The coating solution had a Brookfield viscosity of 500 mPa·s.

TABLE 1

| | | Examples | | | Comparative examples | | |
|---|---|---|---|---|---|---|---|
| | | 1 | 2 | 3 | 1 | 2 | 3 |
| Base paper | Basis weight [g/m$^2$] | 40 | 40 | 30 | 40 | 40 | 40 |
| | Density [g/cm$^3$] | 0.62 | 0.48 | 0.62 | 0.68 | 0.62 | 0.62 |
| | Opacity [%] | 95 | 85 | 88 | 75 | 95 | 95 |
| | Brightness [%] | 55 | 70 | 55 | 75 | 55 | 55 |
| Coating method | | Curtain | Curtain | Curtain | Curtain | Blade | Rod |
| Coating solution | Time to rupture [ms] | 200 | 200 | 200 | 200 | 30 | 30 |
| | Dynamic surface tension [mN/m] | 35 | 35 | 35 | 35 | 55 | 55 |
| Coated paper | Basis weight [g/m$^2$] | 80 | 80 | 70 | 80 | 80 | 80 |
| | Density [g/cm$^3$] | 0.95 | 0.85 | 1.05 | 1.15 | 1.02 | 1.00 |
| | Opacity [%] | 98 | 95 | 95 | 90 | 97 | 97 |
| | Brightness [%] | 77 | 82 | 77 | 85 | 73 | 74 |
| | Brightness variation | ○ | ○ | ○ | ○ | x | Δ |

As shown in the table, Example 1 gives a coated paper having high opacity, brightness and improved brightness variation by curtain coating on a low-brightness base paper as a result of the high light absorption and even coating mass of the base paper and the high light scattering of the coating layer. Example 2 gives a matte coated printing paper having lower opacity and higher brightness as compared with Example 1 by controlling the brightness and density of the base paper in suitable ranges versus Example 1. Example 3 gives a lighter coated printing paper having lower opacity as compared with Example 1 by decreasing the basis weight of the base paper versus Example 1.

However, Comparative example 1 gives a coated paper having higher brightness and lower opacity because the brightness of the base paper exceeds a suitable range as compared with Example 1. In Comparative example 2, brightness variation prominently occurs due to the uneven coating mass and both opacity and brightness are poor due to poor scattering of the coating layer because curtain coating in Example 1 was changed to blade coating. In Comparative example 3, coverage of the base paper with the coating is still insufficient but to a lesser extent than in Comparative example 2, identifiable brightness variation occurs and both opacity and brightness are poor because curtain coating in Example 1 was changed to rod metering size press coating.

The invention claimed is:

1. A process for preparing a matte coated printing paper having a basis weight of 60 to 90 g/m$^2$, a brightness of 75% or more, and an opacity of 95% or more, comprising applying a coating solution containing ground calcium carbonate and precipitated calcium carbonate in the form of spindle-like particles by curtain coating on a base paper having a brightness of 45 to 70% made from a raw material pulp containing a total of 50% or more of waste paper pulp and/or mechanical pulp, and wherein the coating speed of the curtain coating is 800 m/min or more.

2. The process of claim 1 wherein the coating mass per side is 12 to 30 g/m$^2$.

3. The process of claim 1 or 2 wherein said precipitated calcium carbonate in the form of spindle-like particles has an average particle size (D50) of 0.3 to 0.8 μm and a particle size distribution curve determined by the sedimentation method in which the ratio of the particle size of 75 cumulative % by mass of particles (D75) to the particle size of 25 cumulative % by mass of particles (D25) (D75/D25) is 1.5 or more and less than 3.5.

4. The process of claim 1 or 2 wherein the coating solution contains a rheology modifier consisting of a W/O emulsion of an aqueous solution of a polycarboxylic acid copolymer having a weight average molecular weight of 4,000,000 to 50,000,000 dispersed in an organic solvent.

5. A matte coated printing paper prepared by the process of claim 1.

* * * * *